US005226227A

United States Patent [19]

Yoshida

[11] Patent Number: 5,226,227

[45] Date of Patent: Jul. 13, 1993

[54] METHOD OF PRODUCING NARROW TAPE

[75] Inventor: Hiroshi Yoshida, Toyama, Japan

[73] Assignee: Yoshida Kogyo K. K., Tokyo, Japan

[21] Appl. No.: 701,844

[22] Filed: May 17, 1991

[30] Foreign Application Priority Data

May 23, 1990 [JP] Japan ..... 2-133640

[51] Int. Cl.[5] ..... D06B 3/04

[52] U.S. Cl. ..... 28/178; 28/169; 28/182; 8/149

[58] Field of Search ..... 28/178, 179, 180, 181, 28/182, 183, 185, 169, 167, 219, 220; 8/149, 151.2, 147; 68/203, 205 R

[56] References Cited

U.S. PATENT DOCUMENTS

| | | | |
|---|---|---|---|
| 1,311,131 | 7/1919 | Longthorne | 8/149 |
| 2,279,925 | 4/1942 | McCombs | 28/178 |
| 2,348,230 | 5/1944 | Spielmann | 28/169 |
| 3,147,582 | 9/1964 | Schorf | 28/169 |
| 3,503,232 | 3/1970 | Farrer et al. | 68/203 |
| 3,779,704 | 12/1973 | MacHenry et al. | 8/149 |
| 3,922,736 | 12/1975 | Mand et al. | 28/178 |
| 3,981,163 | 9/1976 | Tillotson | 68/5 |
| 4,015,550 | 4/1977 | Bartenfeld et al. | 112/79 A |
| 4,047,271 | 9/1977 | Paterson et al. | 8/149 |
| 4,153,961 | 5/1979 | Cleveland | 8/149 |
| 4,177,037 | 12/1979 | Anderson et al. | 8/149 |
| 4,264,993 | 5/1981 | Freeman et al. | 8/149 |
| 4,932,092 | 6/1990 | Yoshida | 8/149 |

FOREIGN PATENT DOCUMENTS

| | | |
|---|---|---|
| 0081718 | 11/1982 | European Pat. Off. . |
| 1363396 | 4/1963 | France . |

*Primary Examiner*—Clifford D. Crowder
*Assistant Examiner*—Amy Brooke Vanatta
*Attorney, Agent, or Firm*—Hill, Steadman & Simpson

[57] ABSTRACT

A method of producing a colored narrow tape woven or knitted of a weft and a group of warp yarns, comprising: continuously moving the group of warp yarns along a longitudinal path through a dyeing station; coloring the group of warp yarns with a first dye at the dyeing station to a predetermined length to provide a first colored region; providing a noncolored region following to a trailing end of the first colored region; coloring the group of warp yarns with a second dye at the dyeing station to a predetermined length to provide a second colored region following to the noncolored region; and supplying the resulting warp yarns to a subsequent weaving or knitting station.

1 Claim, 3 Drawing Sheets

METHOD OF PRODUCING NARROW TAPE

BACKGROUND OF THE INVENTION

1. Field of the Invention

This invention relates to a method of producing narrow tapes for use as slide fasteners, ribbons, or packing tapes, and more particularly to a method of continuously producing a narrow tape having different colors or figures by using a weft and warp yarns, the latter of which are colored automatically while they are being supplied to a weaving or knitting machine.

2. Description of the Related Art

Heretofore there are several methods of producing a narrow tape having different colors. In one of the simplest methods, while it is being moved, a monochromatic or non-colored woven tape is colored with a dye or is applied a pattern to a desired length, then being dyed with a different color or being applied a different pattern. This method is however performed only by printing. In this case, it is very difficult to have the dyes adhered on the tape uniformly and sufficiently.

To overcome this difficulty, an attempt has been made to produce such a narrow tape by using as warp yarns a variety of colored yarns which are tied, wound on bobbins, and unwound.

In a still further attempt, warp yarns are colored while they are moved to a weaving or knitting machine. For example, although it is not related to a narrow tape, Japanese Patent Laid-Open Publication No. 21488/1977 exemplifies a method of producing a tufted rug. In this method, the tufted rug is produced by weaving tufted yarns which are dyed while they are being moved to a weaving machine. According to this method, yarns for forming figures can be colored as desired simply by replacing a dye in use with another dye, which will promote production efficiency of the rugs.

In the method producing the narrow tape by a number of tied colored yarns, the yarn tying work is inevitable, which would decrease the production efficiency of the tape. This method cannot satisfy demands for production of a good assortment of tapes in a small amount.

On the other hand, if narrow tapes are made by the method of producing the tufted rug, it is impossible to change the dye instantly. In addition, a boundary between a preceding colored region and a succeeding region to be colored would be not colored properly due to running of the dye. Such boundary has to be removed from the tape in a later stage. When it is necessary to produce a narrow tape continuously by changing colors of figures or base colors, or by changing both of the colors of the figures and base colors, a great number of boundaries would be produced accordingly. For example, these boundaries each having a length corresponding to the length of two slide fastener tapes should be removed, which would reduce the production efficiency of the slide fastener tape. Specifically, when producing a variety of tapes in a small amount, it is necessary to change colors frequently, which would adversely affect the production efficiency.

SUMMARY OF THE INVENTION

It is therefore an object of this invention to provide a method of producing narrow tapes, in which processes such as dyeing, and weaving or knitting can be performed in succession to obtain efficiently narrow tapes with few defects.

According to this invention, there is provided a method of producing a colored narrow tape woven or knitted of a weft and a group of warp yarns, comprising: continuously moving the group of warp yarns along a longitudinal path through a dyeing station; coloring the group of warp yarns with a first dye at the dyeing station to a predetermined length to provide a first colored region; providing a non-colored region following to a trailing end of the first colored region; coloring the group of warp yarns with a second dye at the dyeing station to a predetermined length to provide a second colored region following to the noncolored region; and supplying the resulting warp yarns to a subsequent weaving or knitting station.

As a specific feature, this method further includes making a pair of markings on the group of warp yarns at opposite ends of the non-colored region at or after the weaving or knitting station.

In the first aspect of the invention, the group of warp yarns moving is colored firstly with the first dye to a predetermined length as they pass through the dyeing station, whereupon the first dye is replaced by a second dye at the dyeing station so that the group of the warp yarns is colored secondly with the second dye as they continuously pass through the dyeing station. The second coloring starts after a while from termination of the first coloring; that is, a non-colored region is provided between the first and second colored regions.

This non-colored region serves to prevent the dyes on the first colored region from mixing with the dye on the second colored region. The resulting continuous or substantially endless length of narrow tape will finally be cut off at the successive non-colored regions.

To facilitate this cutting, marking threads may be woven or knitted into the opposite ends of each non-colored region.

DETAILED DESCRIPTION

An embodiment of the invention will be described with reference to the accompanying drawing figures.

Figure 5:
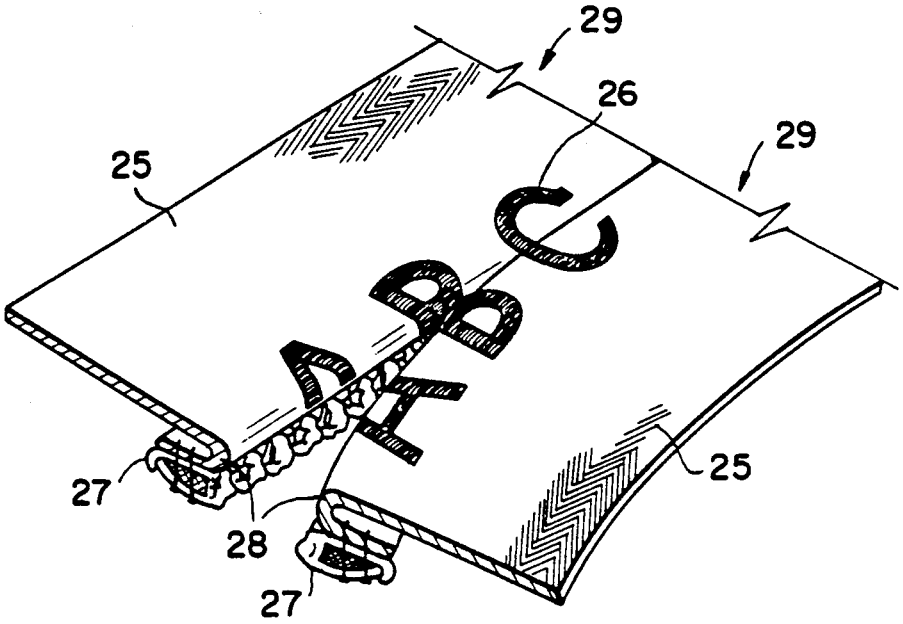
FIG. 5 is a fragmentary perspective view of a slide fastener tape made from the narrow tape produced according to the invention.
Figure 6:
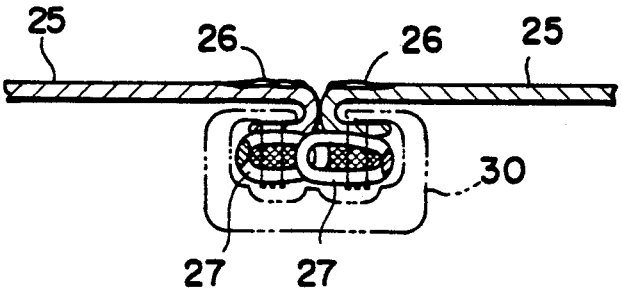
FIG. 6 is a transverse cross-sectional view of FIG. 5.

FIGS. 5 and 6 show a slide fastener tape produced according to the invention.

In FIG. 5, a slide fastener tape 25 has a woven FIG. 26. The tape 25 is usually made of a polyester fiber, but may be any synthetic resin or natural fiber. In this embodiment, the tape is made by an. electronic Jacquard weaving machine. When the tape has no complicated figures, it is often knitted.

As shown in FIG. 5, one side edge of the tape is folded so that a slide fastener element 27 in coil shape is attached to the folded edge to form one of a pair of stringers 29. A pair of fastener tapes having slide fastener elements 27 are mated so that the slide fastener elements 27 will be inserted through a slider 30. Then the end of the tapes will be fixed by a stop. Thus the slide fastener tape will be produced in a series of the processes including the weaving.

Figure 1:
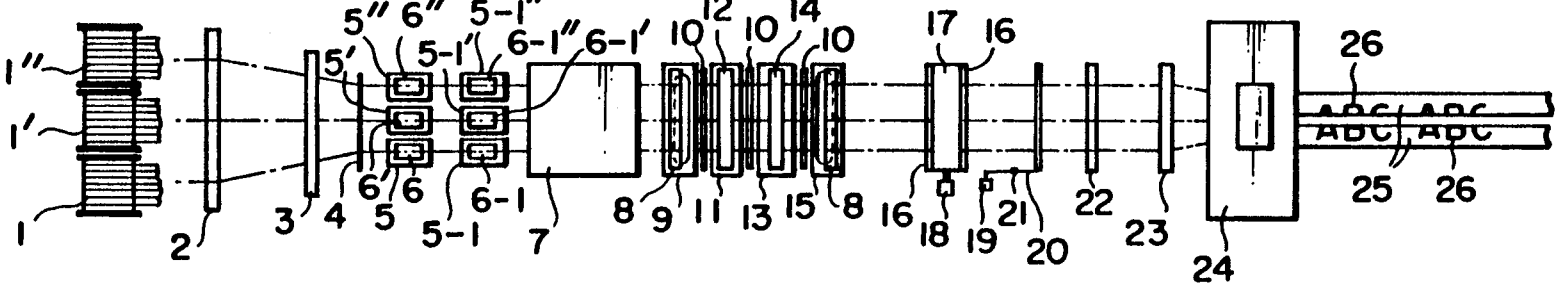
FIG. 1 is a schematic top plan view showing a narrow tape producing machine in which this invention is applied.
Figure 2:
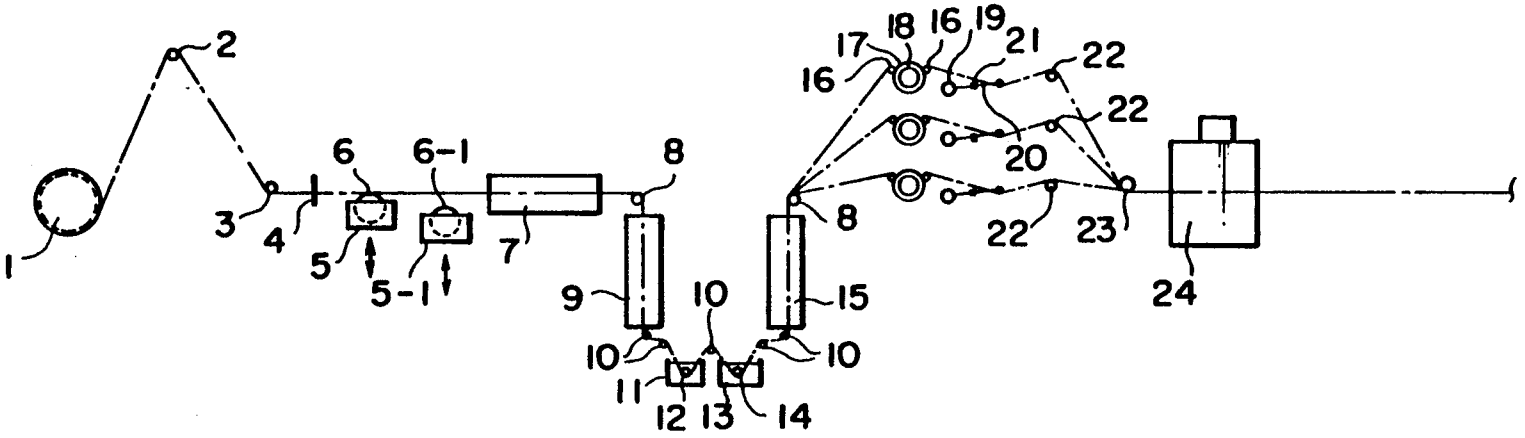
FIG. 2 is a schematic side elevation of the machine of FIG. 1.
Figure 3:
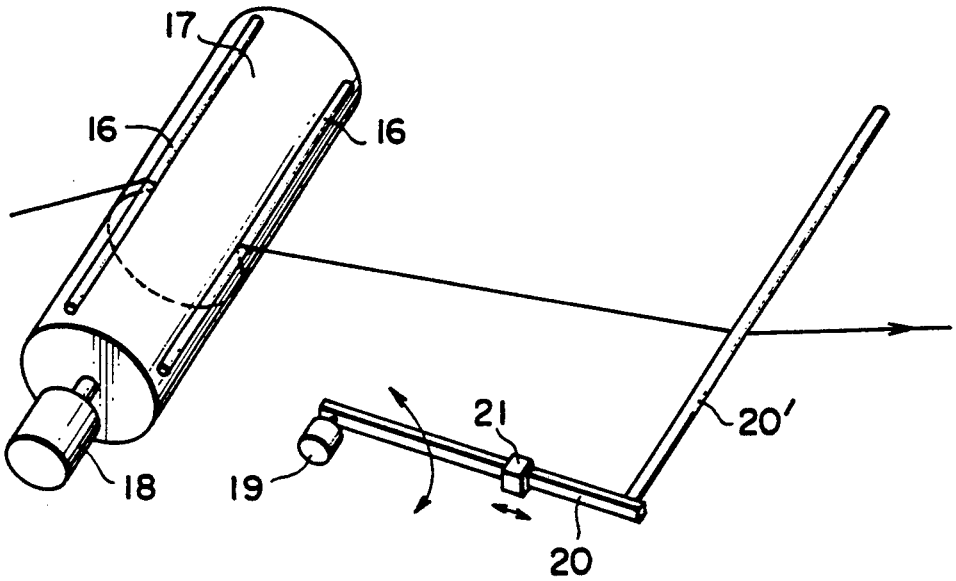
FIG. 3 shows a configuration of a tension control unit of the machine of FIG. 1.

FIGS. 1 to 3 is a schematic view of a machine for producing the fastener tape 25 according to the invention.

In FIG. 1, reference numeral 1 stands for warp beams on which groups of non-colored warp yarns are wound. Three warp beams are used in the embodiment. The middle warp beam 1' has warp yarns for forming the FIG. 26. A guide 2 guides via a reed 4 the warp yarns unwound simultaneously at a constant speed from the warp beams 1, 1', 1'' to a first dyeing station. The guide 2 is usually a round bar or a roll.

The first dyeing station includes dye liquor padding troughs 5, 5', 5'' for the respective groups of the warp yarns, and three padding rolls 6, 6, 6'' which are partly immersed in the troughs 5, 5', 5''. Next to, i.e. downstream of, the first dyeing station, a second dyeing station is located, including three dye liquor padding troughs 5-1, 5-1', 5-1'', and three padding rolls 6-1, 6-1', 6-1'' which are partly immersed in the troughs 5-1, 5-1', 5-1''.

One of the mating padding troughs 5 and 5-1 ( 5' and 5-1', or 5'' and 5-1'') located in tandem in the moving direction of the warp yarns is ascended or descended automatically by a non-illustrated lift depending upon whether the other mating padding trough is used for dyeing. The troughs 5, 5', 5'' (and the troughs 5-1, 5-1', 5-1''), which are juxtaposed perpendicularly of the groups of the moving warp yarns, are ascended or descended optionally. Sometimes the troughs 5 and 5'' are ascended while the trough 5' is descended. In this case, it follows that the troughs 5-1 and 5-1'' are descended while the trough 5-1' is ascended.

The following devices are located in the named order in the downstream of the dyeing stations: a drying zone 7 which is kept at a predetermined temperature; a color developing zone 9 which is maintained hot and dry; a reducing trough II for reducing oxides adhering to the warp yarns; a washing trough 13 for washing the warp yarns which are color-developed and fixed; a drying zone 15; and an electronic Jacquard weaving machine 24.

Rolls 12, 14 are immersed in the reducing trough 11 and the washing trough 13, respectively. The warp yarns are guided in succession into the troughs 11, 13 by the rolls 12, 14.

Tension control units are located between the drying zone 15 and the electronic Jacquard weaving machine 24 so as to control the tension of the respective groups of the warp yarns. Each tension control unit matches the dyeing speed in the dyeing stations and the weaving speed of the weaving machine, keeping the warp yarns tensioned constantly. Each tension control unit is constructed as shown in FIG. 3. In FIG. 3, reference numeral 17 stands for a feed roll driven to move the warp yarns. Each roll 17 is connected by its shaft to a motor 18 which changes its rotation speed according to a signal from a potentiometer 19. Two guide bars 16 are separately located on the surface of the roll 17 in parallel with the roll shaft. The warp yarns are guided on the roll surface via the guide bars 16, 16, being fed to the electronic Jacquard weaving machine via the guide bars 22, 22, . . .

One end of each rocking lever 20 is fixedly connected to the rotary shaft of the potentiometer 19 which is mounted on the weaving machine frame between the roll 17 and guide bars 22, 22.

A tension sensor 20' is connected to the other end of the rocking lever 20. A tension control weight 21 is located on the rocking lever 20 so as to be slidable and fixed thereon, tensioning the warp yarns as desired. The tension sensor 20' is disposed perpendicularly of each group of the warp yarns, being movable upwardly and downwardly according to the tension of the warp yarns. The movement of the tension sensor 20' is informed to the potentiometer 19. Values proportional to variations of the rotation angles of the potentiometer are inputted to a non-illustrated control unit. The motor 18 changes its rotation speed according to the signal based on the values so as to keep the warp yarns tensioned constantly.

In FIGS. 1 to 3, reference numerals 8, 10, 23 represent guide bars.

In operation, the groups of the warp yarns are colored with dyes as described hereinafter. Firstly, the liquor padding troughs 5, 5', 5'', 5-1, 5-1', 5-1'' are filled with liquors containing dyes and assistants. For example, the troughs 5 and 5'' are filled with the same base dye liquor for coloring warp yarns. The trough 5' contains a dye liquor for coloring the warp yarns to form the FIG. 26. The troughs 5-1, 5-1', 5-1'' are filled with dye liquors for developing different colors. For instance, the troughs 5-1, 5-1'' are filled with a dye liquor which develops a tone different from that of the dye liquor in the troughs 5, 5'. In addition, the trough 5-1' is filled with a dye liquor which develops a tone different from that in the trough 5' to form the FIG. 26. These troughs 5, 5', 5'' and 5-1, 5-1', 5-1'' are selectively ascended and descended according to timings determined by a non-illustrated control unit.

According to the invention, the warp yarns are colored with the dyes to the predetermined length while passing selectively through the first or second dyeing stations in succession.

When the warp yarns are colored to the predetermined length, the dyeing station in use will be replaced by a standby dyeing station, which will be used in a predetermined period of time. During this while, a non-colored region is provided following the colored region on the warp yarns. This non-colored region means that the warp yarns are not colored.

This process will be described with reference to the pair of the liquor padding troughs 5 and 5-1' which are located in tandem in the moving direction of the warp yarns. As shown in FIG. 2, when the trough 5 is at the upper position and the trough 5-1 is at the lower position, the warp yarns are dyed by the padding roll 6 in the trough 5.

When the warp yarns are colored to the predetermined length, the trough 5 is descended from the upper position. In the predetermined period of time, the trough 5-1 is moved to the upper position. Both of the troughs 5 and 5-1 are located in tandem with a predetermined space between them, and the warp yarns are moved at the constant speed. Therefore timings for ascending and descending the troughs 5 and 5-1 can be determined so long as the length of the non-colored region of the warp yarns is determined beforehand. The troughs 5 and 5-1 are alternately ascended or descended by a non-illustrated driving unit such as a hydraulic cylinder, which is operated by the non-illustrated control unit according to the timings mentioned above.

For example, when the warp yarns are colored in the trough 5 to the predetermined length and then are to be colored in the trough 5-1, the trough 5-1 will be lifted to the upper position with the time lag t, which is determined by the following equation:

$$t = \frac{L + L'}{V}$$

where L stands for the distance between the troughs 5 and 5-1, V: the moving speed of the warp yarns, L': the length of the non-colored region.

The time lag t' to start the coloring in the trough 5 after the coloring in the trough 5-1 is finished is determined as follows. The distance L between the troughs 5 and 5-1 is usually larger than the length L' of the non-colored region on the warp yarns. Therefore, when the trough 5-1 is at the upper position, the trough 5 is also ascended to the upper position according to the timing to start coloring. Then the trough 5-1 is descended to the lower position with the time lag t' which is determined by:

$$t = \frac{L + L'}{V}$$

The other pairs of the troughs 5' and 5-1', and 5'' and 5-1'' are also ascended and descended according to timings similar to those described above.

It is not however always necessary that the troughs 5, 5' and 5'' (and the troughs 5-1, 5-1' and 5-1'') are ascended or descended simultaneously. For instance, when the warp yarns for forming the FIG. 26 are colored with a different dye, only the troughs 5' and 5-1' are ascended or descended according to the above described timings while the other troughs 5, 5'', 5-1 and 5-1'' are controlled to be stationary.

The groups of the warp yarns on which the pad dyes are applied in the troughs are moved to the drying zone to be dried temporarily. Then the warp yarns are carried to the color developing zone via a guide bar 8. The pad dyes on the warp yarns are developed in a dry and hot atmosphere in the color developing zone. Oxides stuck to the warp yarns are then neutralized through the reduction trough 11. The Warp yarns are Washed in the washing trough 13, being guided to the drying zone 15 via a pair of guide bars 10, 10. Thus the warp yarns are dyed completely, being carried to the electronic Jacquard weaving machine 24.

The tension control unit is located between the drying zone 15 and the Jacquard weaving machine 24 so as to control the tension of the warp yarns as well as the moving speed of the warp yarns according to the difference between the coloring speed and the weaving speed.

In the foregoing embodiment, the warp yarns are woven by the weaving machine 24 into two strips of the slide fastener tapes 25 having the FIG. 26 as shown in FIG. 1. Then the woven tapes 25 are subject to a fastener producing process successively, so that they are made into a slide fastener tape as shown in FIGS. 5 and 6.

Figure 4:
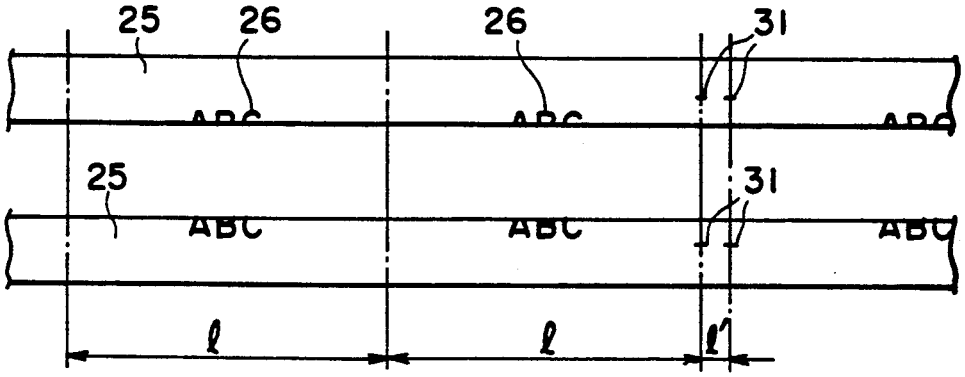
FIG. 4 is an enlarged top plan view showing a non-colored region between a preceding colored region and a succeeding colored region of a narrow tape.

FIG. 4 shows non-colored regions on the woven tapes 25. In FIG. 4, l stands for a length of one slider faster tape, and l' stands for the length of the non-colored region notifying that the warp yarns will be colored with a different dye. The length l' of the non-colored region is usually set for approximately 5 centimeters. When considering control errors, this length of the non-colored region is sufficient enough to assure that the warp yarns are colored with a different dye in succession without mixing of the preceding and succeeding dyes. Each of the noncolored regions will be cut off finally.

To facilitate cutting of the non-colored regions automatically, marking yarns are woven into the tapes to give marks 31, 31 (shown in FIG. 4) by the weaving machine. The marks 31, 31 may be manually applied to the tapes.

In the foregoing embodiment, a pair each of the padding liquor troughs are located in succession along the moving direction of the warp yarns. One or more pairs of the padding liquor troughs can be used. In addition, arrangement of the dyeing stations and their related units may be changed as desired. The structure of the tension control unit is not limited to that described previously. It will be understood that various changes and modifications may be made in the embodiment without departing from the scope of the appended claims.

What is claimed is:

1. A method of producing a colored narrow tape woven or knitted of a weft and at least two groups of warp yarns, said method comprising the following steps:

continuously moving said groups of warp yarns along a longitudinal path;

providing a first dyeing station containing a first dye, and a second dyeing station containing a second dye, along said longitudinal path;

coloring a predetermined length of said groups of warp yarns with said first dye at said first dyeing station to form a region of said groups of warp yarns that is colored with said first dye;

allowing said groups of warp yarns to move along said longitudinal path without being colored outside the boundaries of said predetermined length, thereby providing an undyed region of said warp yarns immediately adjacent to and following said region of said groups of warp yarns that is colored with said first dye;

coloring a predetermined length of said groups of warp yarns with said second dye at said second dyeing station to form a region of said groups of warp yarns that is colored with said second dye, said region of said groups of warp yarns that is colored with said second dye being immediately adjacent to and following said undyed region of said warp yarns;

supplying the groups of warp yarns including a region colored with said first dye followed by an undyed region, followed by a region colored with said second dye, to a subsequent weaving or knitting machine; and making a pair of markings on said group of warp yarns at opposite ends of said undyed region at or after the weaving or knitting station.

* * * * *